US008192110B1

(12) United States Patent
Bryant et al.

(10) Patent No.: US 8,192,110 B1
(45) Date of Patent: Jun. 5, 2012

(54) YARD STORM DRAIN EMITTER

(76) Inventors: Donald W. Bryant, Havana, IL (US); Nina M. Bryant, Havana, IL (US)

( * ) Notice: Subject to any disclaimer, the term of this patent is extended or adjusted under 35 U.S.C. 154(b) by 0 days.

(21) Appl. No.: 12/401,589

(22) Filed: Mar. 10, 2009

(51) Int. Cl.
*E02B 13/02* (2006.01)

(52) U.S. Cl. ..... 405/40

(58) Field of Classification Search ..... 404/25–26; 52/19–20; 405/36, 39, 40; 210/170.03, 163, 210/164
See application file for complete search history.

(56) References Cited

U.S. PATENT DOCUMENTS 3,455,059 A * 7/1969 Evans ..... 49/397
6,749,363 B1 * 6/2004 Petersen ..... 404/25
6,957,927 B1 * 10/2005 Petersen ..... 404/25

FOREIGN PATENT DOCUMENTS

EP 420778 A1 * 4/1991

OTHER PUBLICATIONS

EP 420778 A1 document and its corresponding translation.*
EP 420778 A1 document and its corresponding translation, dated Feb. 8, 2012.*

* cited by examiner

*Primary Examiner* — Sunil Singh

(57) ABSTRACT

A yard storm drain emitter includes a male fitting having a fitting interior, a flange carried by the male fitting and having a drain opening communicating with the fitting interior, a lid attachment member carried by the flange and a lid pivotally carried by the lid attachment member and having a lid rear surface with a planar portion and a convex portion extending from the planar portion. The convex portion of the lid rear surface contacts the lid attachment member as the lid is pivoted from a closed position to an open position and the planar portion of the lid rear surface contacts the lid attachment member at the open position of the lid.

5 Claims, 5 Drawing Sheets

YARD STORM DRAIN EMITTER

FIELD OF THE INVENTION

The present disclosure relates to storm drains and the like. More particularly, the present disclosure relates to a yard storm drain emitter which is less susceptible to being clogged with debris than conventional storm drain emitters.

BACKGROUND OF THE INVENTION

In heavy rains accompanied by storms, rainwater may have a tendency to pool in yards and on driveways, patios or other areas around a building. Therefore, it may be desirable to have appropriate drainage facilities in these areas. However, conventional storm drain emitters may have a tendency to become clogged with sticks, leaves, trash and other debris.

Therefore, a yard storm drain emitter which is less susceptible to becoming clogged with debris is needed.

SUMMARY

The present disclosure is generally directed to a yard storm drain emitter. An illustrative embodiment of the yard storm drain emitter includes a male fitting having a fitting interior, a flange carried by the male fitting and having a drain opening communicating with the fitting interior, a lid attachment member carried by the flange and a lid pivotally carried by the lid attachment member and having a lid rear surface with a planar portion and a convex portion extending from the planar portion. The convex portion of the lid rear surface contacts the lid attachment member as the lid is pivoted from a closed position to an open position and the planar portion of the lid rear surface contacts the lid attachment member at the open position of the lid.

BRIEF DESCRIPTION OF THE DRAWINGS

The disclosure will now be made, by way of example, with reference to the accompanying drawings, in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention which is defined by the claims. Furthermore, there is no intention to be bound by any expressed or implied theory presented in the preceding technical field, background, brief summary or the following detailed description.

Figure 3:
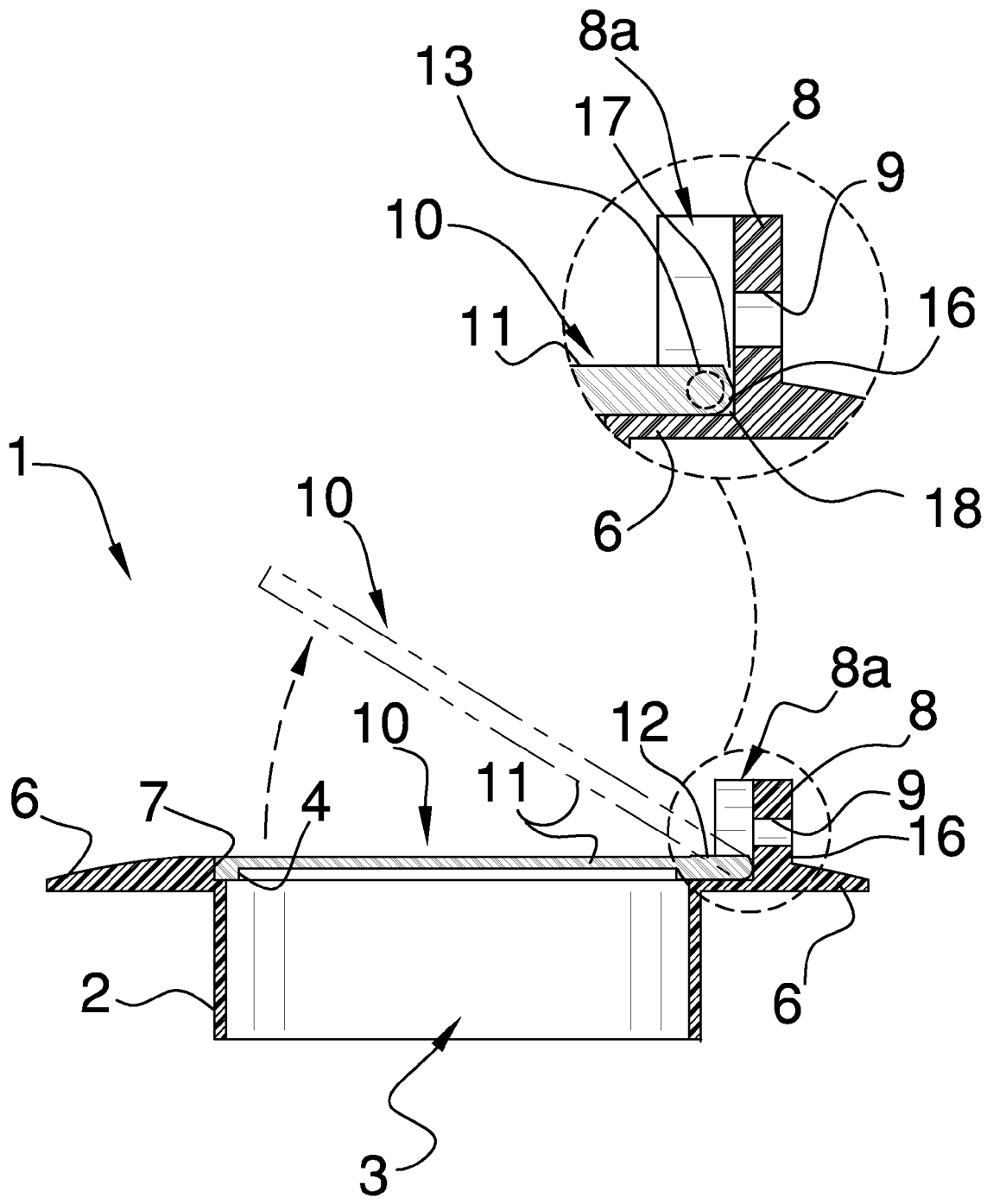
FIG. 3 is a sectional view, taken along section lines 3-3 in FIG. 2, of an illustrative embodiment of the yard storm drain emitter.

Referring to the drawings, an illustrative embodiment of the yard storm drain emitter is generally indicated by reference numeral 1. The yard storm drain emitter 1 may include a generally cylindrical male fitting 2 having a fitting interior 3 (FIG. 3). A flange 6 may extend outwardly from an upper edge of the male fitting 2. The flange 6 may have a drain opening 7 which communicates with the fitting interior 3 of the male fitting 2. In some embodiments, the drain opening 7 may have a diameter of about 4 inches and may be configured with no restrictions for discharging water and most debris in application of the yard storm drain emitter 1 which will be hereinafter described. A generally elongated lid attachment member 8 may extend from the flange 6 generally adjacent to the drain opening 7. A lid flange gap 8*a* may be provided in the lid attachment member 8 in facing relationship with respect to the drain opening 7. A drain opening 9 may extend through the lid attachment member 8 in communication with the lid flange gap 8*a*.

Figure 1:
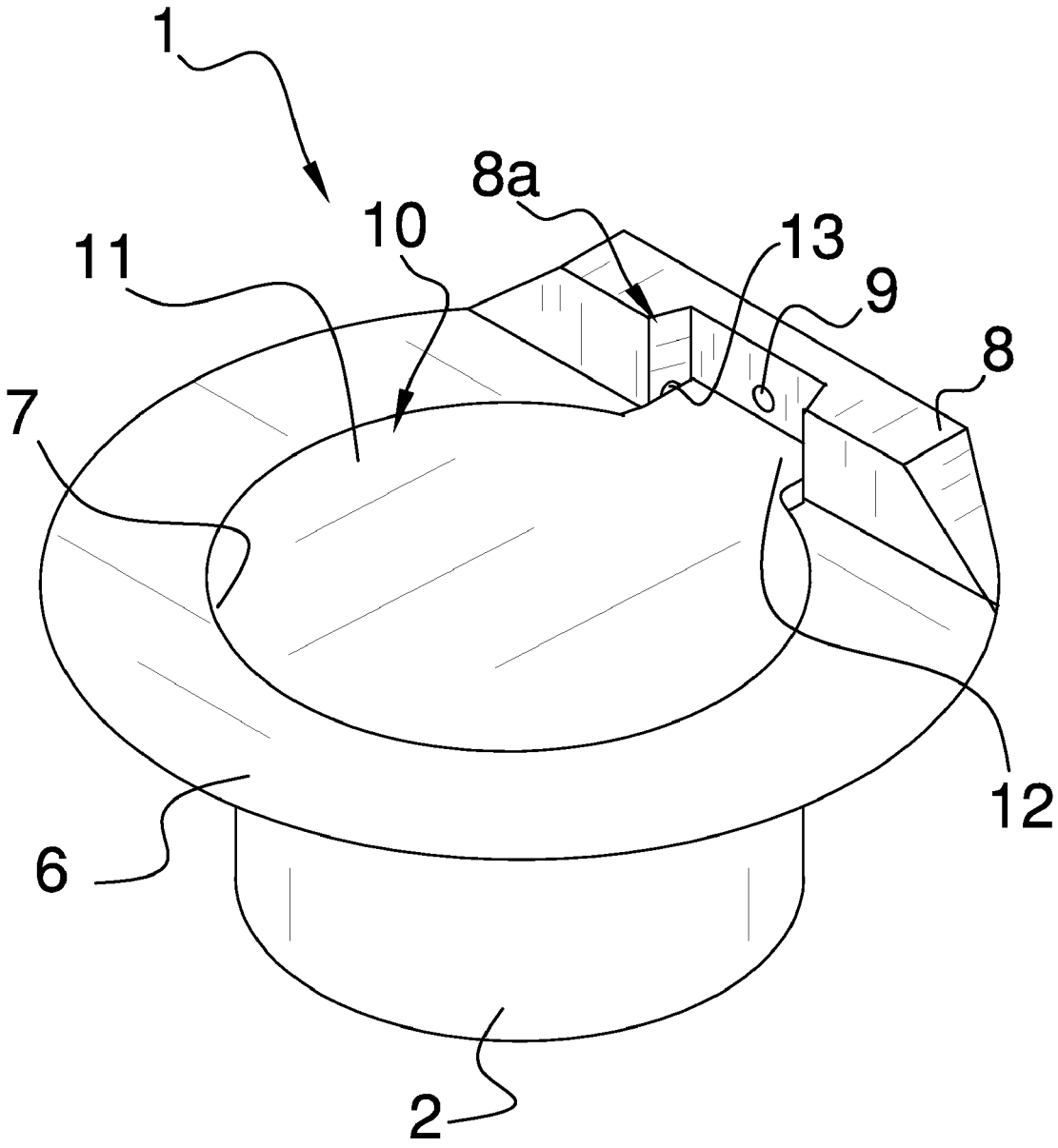
FIG. 1 is a front perspective view of an illustrative embodiment of the yard storm drain emitter.
Figure 2:
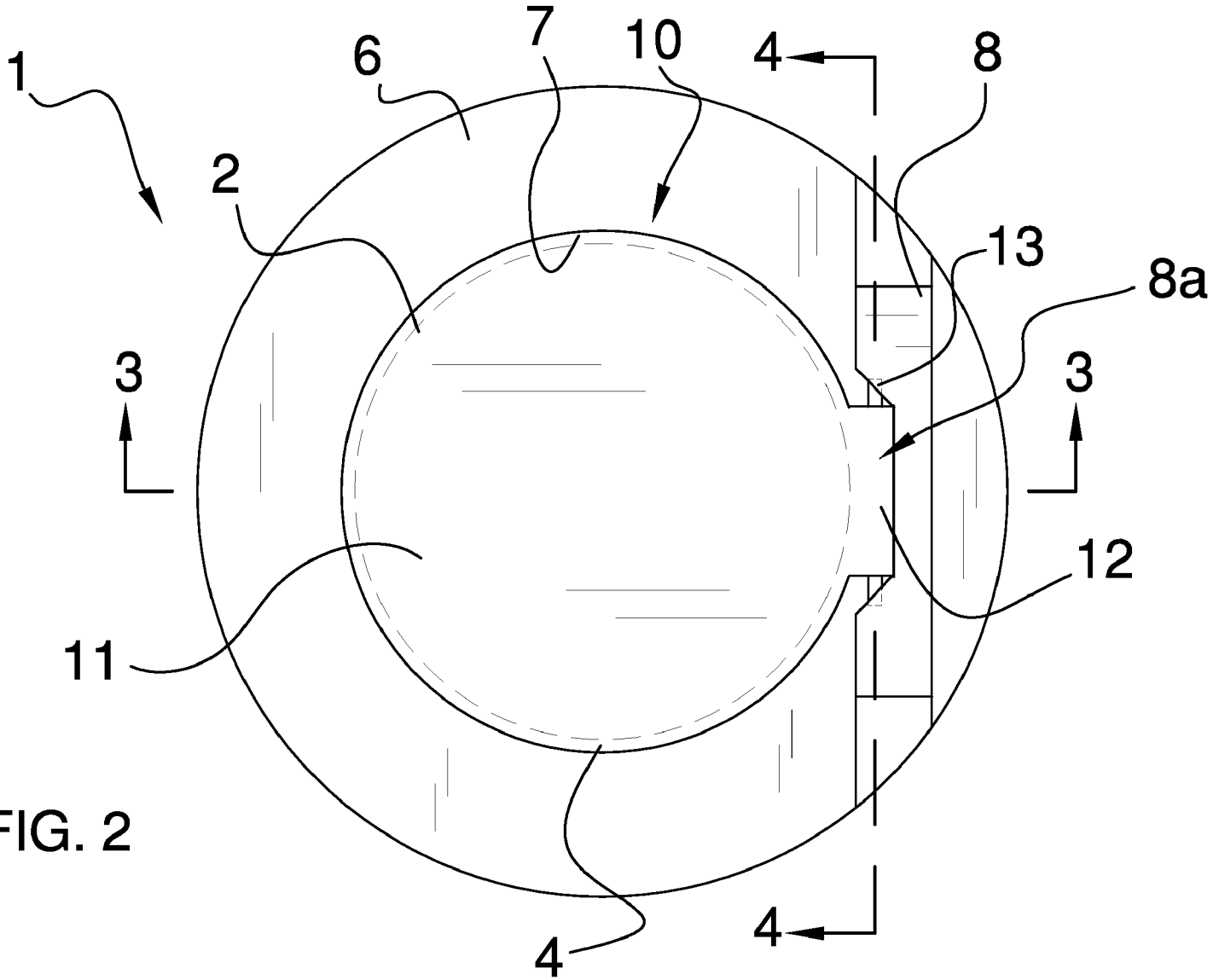
FIG. 2 is a top view of an illustrative embodiment of the yard storm drain emitter.
Figure 4:
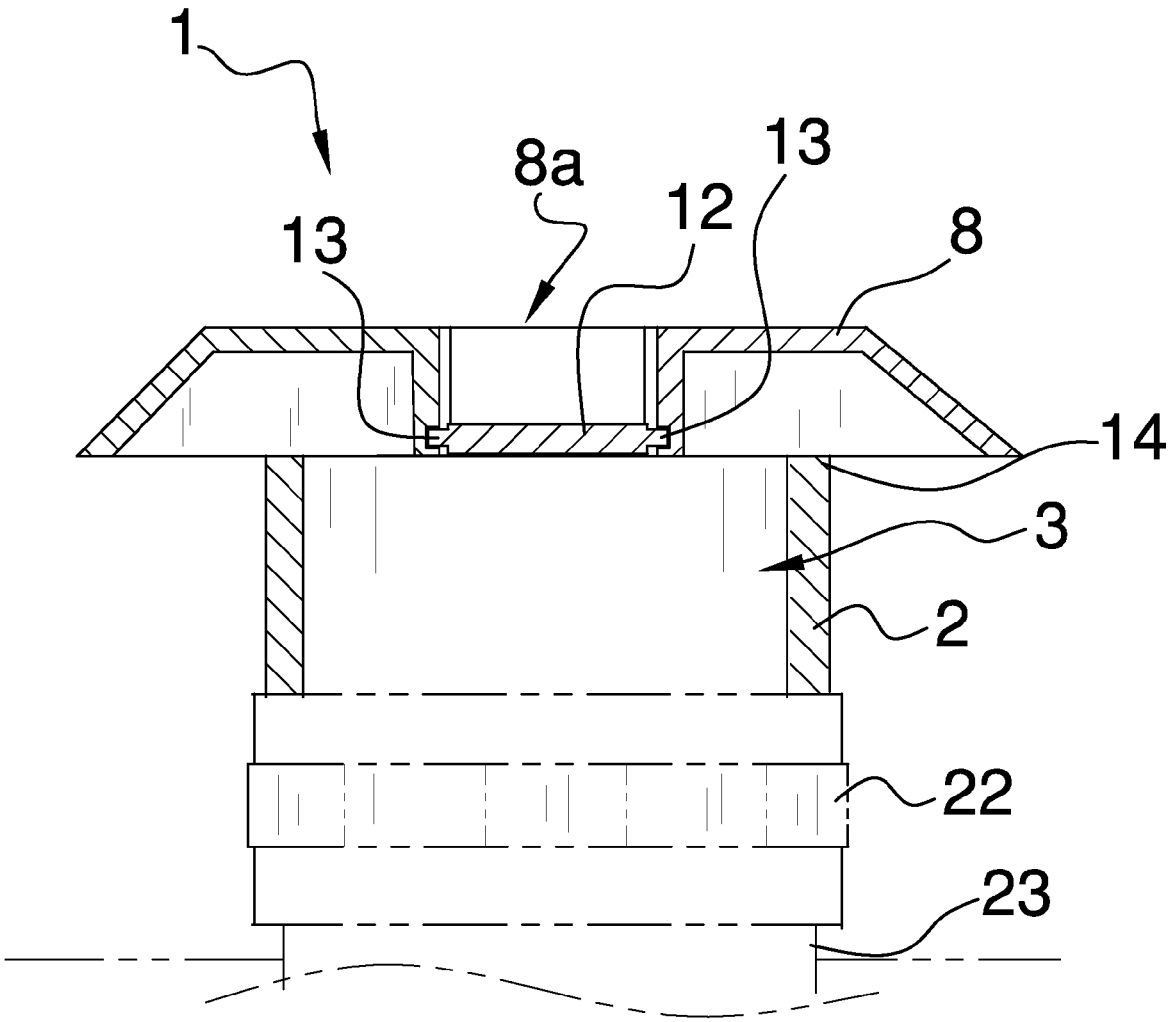
FIG. 4 is a sectional view, taken along section lines 4-4 in FIG. 2, of an illustrative embodiment of the yard storm drain emitter.

A lid 10 includes a circular lid panel 11 which may be removably seated in the drain opening 7 of the flange 6. As shown in FIGS. 2-4, the upper edge of the male fitting 2 may define a lid seat 4 on which the lid panel 11 seats when inserted in the drain opening 7. In some embodiments, the lid panel 11 may have a diameter of about 4 3/16". A lid flange 12 may extend from the lid panel 11 into the lid flange gap 8*a* of the lid attachment member 8. The lid flange 12 may be pivotally attached to the lid attachment member 8 according to the knowledge of those skilled in the art. As shown in FIGS. 2 and 4, in some embodiments, a pair of lid flange pins 13 may extend outwardly from the lid flange 12 and snap into respective pin openings (not shown) provided in the lid attachment member 8 on respective sides of the lid flange gap 8*a* to pivotally mount the lid 10 to the lid attachment member 8. In some embodiments, the lid flange 12 may be friction-fitted in the lid flange gap 8*a* such that the lid 10 can be secured in the raised position.

Figure 5:
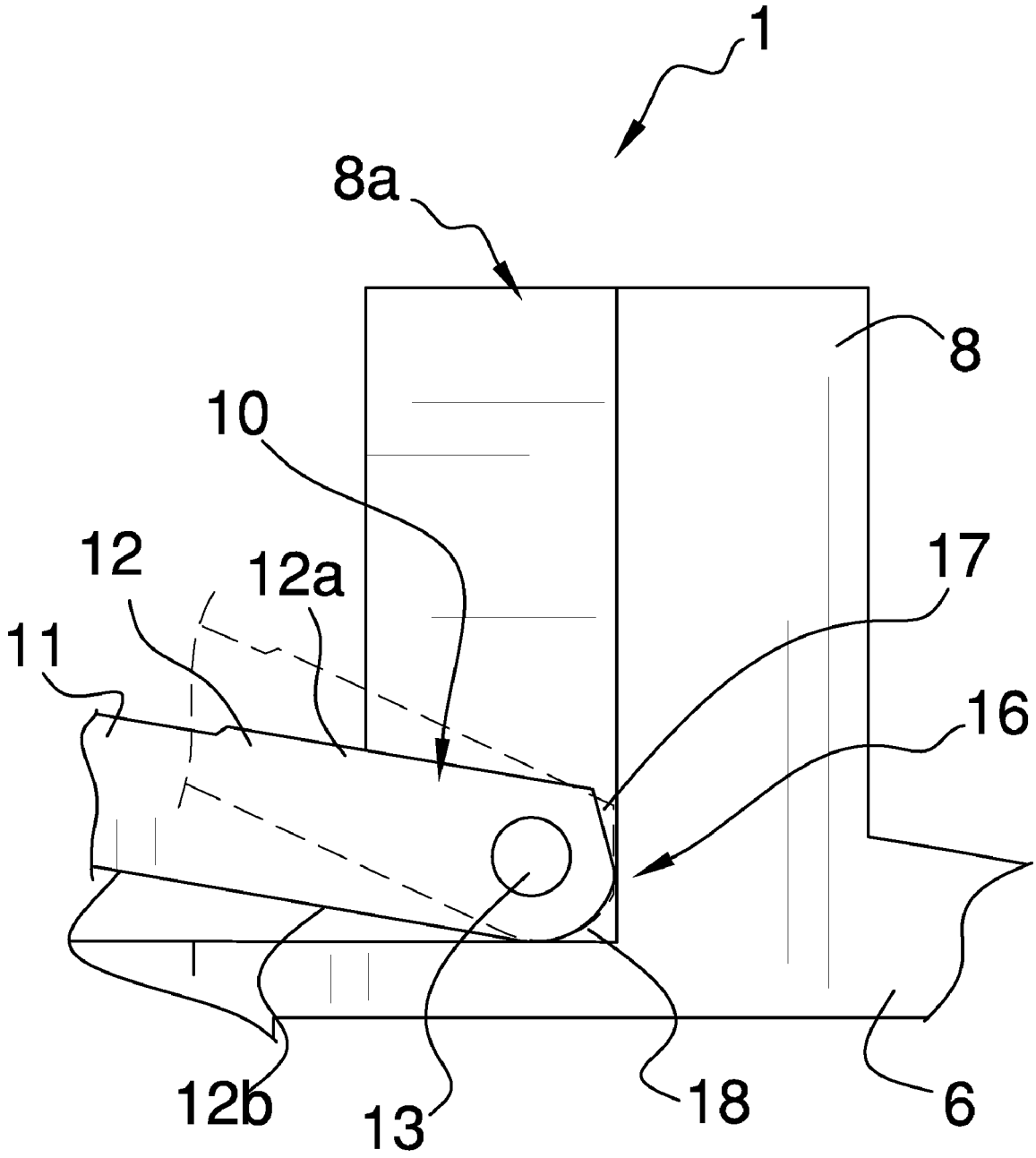
FIG. 5 is a side view illustrating pivoting of a lid of an illustrative embodiment of the yard storm drain emitter between partially opened positions.

As shown in FIG. 5, the lid flange 12 of the lid 10 may have a lid rear surface 16 having a generally planar portion 17 and a generally convex portion 18 which extends from the planar portion 17. The planar portion 17 may be disposed at an obtuse angle with respect to an upper surface 12*a* of the lid flange 12. The convex portion 18 may be continuous with a lower surface 12*b* of the lid flange 12. Accordingly, as shown in FIG. 5, the convex portion 18 of the lid rear surface 16 engages the lid attachment member 8 as the lid 10 is raised from the lowered position in the drain opening 7 to the partially-raised position shown in phantom in FIG. 5, until the planar portion 17 engages the lid attachment member 8. Engagement of the planar portion 17 with the lid attachment member 8 prevents further pivoting and raising of the lid along the lid flange pins 13. In some embodiments, engagement of the planar portion 17 with the lid attachment member 8 may allow the lid 10 to be raised to a maximum height of about 1¾ inches. This may prevent damage to the lid 10 by a lawnmower when the yard storm drain emitter 1 is installed in a yard (not shown) or other area.

As shown in FIG. 4, in typical application the yard storm drain emitter 1 may be installed in a yard or other area (not shown) to facilitate drainage of storm water and small quantities of debris during storm conditions, for example. Accordingly, a suitable drain fitting 22 may be used to attach the lower end of the male fitting 2 to a drain conduit (not shown) which extends into the ground. In some embodiments, the male fitting 2 may be designed to set within a female opening of a standard fl-inch PVC elbow or coupling 23. The coupling 23 may be connected to a drain conduit (not shown) of a drainage system (not shown).

Under normal conditions, the lid panel 11 of the lid 10 may be inserted in the drain opening 7 of the flange 6 and seated on the upper end or edge of the male fitting 2. Under circumstances in which it is desired to mow grass (not shown) which grows adjacent to the yard storm drain emitter 1 with a lawnmower (not shown), a rod or the like (not shown) may be inserted through the drain opening 9 in the lid attachment member 8 to secure the lid 10 in the drain opening 7. This may prevent the lawnmower from inadvertently striking and damaging the lid 10.

Under storm conditions, the lid 10 may be raised from the drain opening 7 to facilitate drainage of storm water and small quantities of debris (not shown) through the drain opening 7 and fitting interior 3, respectively, of the male fitting 2 and ultimately through the drain conduit 23 (FIG. 4) and the drainage system (not shown) to which the drain conduit 23 is connected. Accordingly, as shown in FIG. 5, as the lid 10 is initially pivoted and raised, the convex portion 18 of the lid rear surface 16 contacts the lid attachment member 8. Ultimately, the planar portion 17 of the lid rear surface 16 on the lid flange 12 engages the lid attachment member 8 and prevents further pivoting and raising of the lid 10. This exposes the drain opening 7 and facilitates drainage of storm water, debris and the like from the yard or other area through the drain opening 7. Limiting the height to which the lid 10 can be raised may prevent inadvertent damage to the lid 10 by a lawnmower (not shown) during mowing of grass around the yard storm drain emitter 1.

While illustrative embodiments of the disclosure have been described above, it will be recognized and understood that various modifications can be made and the appended claims are intended to cover all such modifications which may fall within the spirit and scope of the disclosure.

What is claimed is:

1. A yard storm drain emitter, comprising:

a male fitting having a fitting interior;

a flange carried by said male fitting and having a drain opening communicating with said fitting interior;

a lid attachment member carried by said flange; said lid attachment member comprises a wall, said wall extends vertically from said flange;

a lid pivotally carried by said lid attachment member forming a lid/lid attachment member assembly, the lid has a top planar surface, a bottom planar surface parallel to said top planar surface, a rear surface that connects the top planar surface and the bottom planar surface, said rear surface having a planar portion and a convex portion extending from said planar portion, said planar portion and said convex portion of the lid intersects at a point that is in contact with said lid attachment member thus providing improved structural integrity of said lid/lid attachment member assembly, the planar portion of the rear surface is not co-planar with the top planar surface; and wherein said convex portion of said lid rear surface contacts said lid attachment member as said lid is pivoted from a closed position to an open position and said planar portion of said lid rear surface contacts said lid attachment member at said open position of said lid.

2. The yard storm drain emitter of claim 1 wherein said lid comprises a circular lid panel and a lid flange extending from said lid panel and pivotally attached to said lid attachment member.

3. The yard storm drain emitter of claim 2 further comprising a lid flange gap provided in said lid attachment member and wherein said lid flange extends into said lid flange gap.

4. The yard storm drain emitter of claim 3 further comprising a pair of lid flange pins extending from said lid flange and engaging said lid attachment member.

5. The yard storm drain emitter of claim 1 further comprising a lid seat provided on said male fitting and supporting said lid when said lid is in said closed position.

* * * * *